US006665986B1

(12) United States Patent
Kaplan

(10) Patent No.: US 6,665,986 B1
(45) Date of Patent: Dec. 23, 2003

(54) PHOSPHORESCENT PAVING BLOCK

(76) Inventor: Kevin Marshall Kaplan, 131 High St., Clawson, MI (US) 48017

( * ) Notice: Subject to any disclaimer, the term of this patent is extended or adjusted under 35 U.S.C. 154(b) by 0 days.

(21) Appl. No.: 10/137,270

(22) Filed: May 2, 2002

(51) Int. Cl.[7] ..... E01F 9/016; E01F 9/04

(52) U.S. Cl. ..... 52/102; 52/103; 52/104; 250/458.1; 250/461.1; 250/462.1

(58) Field of Search ..... 52/102, 103, 104, 52/105; 250/361 R, 365, 367, 363.01, 363.04, 458.1, 461.1, 462.1, 526

(56) References Cited

U.S. PATENT DOCUMENTS 3,478,209 A * 11/1969 Feuer ..... 250/467.1
4,242,831 A * 1/1981 O'Shaughnessy ..... 446/219
4,737,049 A * 4/1988 Callhan ..... 359/551
5,008,551 A * 4/1991 Randolph ..... 250/462.1
5,038,542 A * 8/1991 Kline ..... 52/306
5,118,951 A * 6/1992 Kherani et al. ..... 250/462.1
5,271,754 A * 12/1993 Bauerecker et al. ..... 65/17.3
5,300,783 A * 4/1994 Spencer et al. ..... 250/462.1
5,904,017 A * 5/1999 Glatz et al. ..... 52/287.1
5,951,144 A * 9/1999 Gavigan et al. ..... 362/153

FOREIGN PATENT DOCUMENTS

DE 29900284 U1 * 3/1999

* cited by examiner

*Primary Examiner*—Jeanette Chapman

(57) ABSTRACT

The present invention essentially comprises a phosphorescent paving block having a paving base, and a phosphorescent material in contact with the paving base. Additionally the paving block can also have a light-transmitting cover and a light-transmitting base on either side of the phosphorescent material to form a laminate.

1 Claim, 2 Drawing Sheets

PHOSPHORESCENT PAVING BLOCK

BACKGROUND OF THE INVENTION

1. Field of the Invention

The present invention relates to a phosphorescent paving block for use in connection with outdoor lighting. The phosphorescent paving block has particular utility in connection with phosphorescent paving blocks being used for outdoor lighting.

2. Description of the Prior Art

Paving blocks are used for walkways, driveways and paths. The paving blocks allow ground motion without cracking like cement and can be laid in various patterns that are aesthetically pleasing. Walkway lighting has also been used along with such paving blocks to increase safety and make for more sure footing or parking. The majority of walkway lighting is wired with low voltage electricity, there are electrical consumption costs associated with the use of such a system and difficulties in setup if the walkway is a long one or is located at a distance from an electrical outlet.

The use of outdoor lighting is known in the prior art. For example, U.S. Pat. No. 6,027,280 to Conners et al. discloses an interlocking paving block with interior illumination capability. However, the Conners et al '280 patent does not allow for non-electrical use of an outdoor light.

Similarly, U.S. Pat. No. 5,472,737 to Anders discloses a phosphorescent highway paint composition that is painted on highways to aid in driving. However, the Anders '737 patent does not disclose the use of paving blocks.

Lastly, U.S. Pat. No. 6,005,024 to Anders et al. discloses a phosphorescent epoxy overlay that covers existing signs and gives moisture stability to the phosphorescent material. However, the Anders et al. '024 patent does not disclose the use of paving blocks.

While the above-described devices fulfill their respective, particular objectives and requirements, the aforementioned patents do not describe a phosphorescent paving block that allows phosphorescent paving block being used for outdoor lighting. The Conners et al '280 patent makes no provision for non-electrical use, since it includes an inset bulb and wiring, and neither Anders '737 or Anders et al. '024 disclose the use of phosphorescent material in conjunction with paving blocks.

Therefore, a need exists for a new and improved phosphorescent paving block which can be used for phosphorescent paving block being used for outdoor lighting. In this regard, the present invention substantially fulfills this need. In this respect, the phosphorescent paving block according to the present invention substantially departs from the conventional concepts and designs of the prior art, and in doing so provides an apparatus primarily developed for the purpose of phosphorescent paving block being used for outdoor lighting.

SUMMARY OF THE INVENTION

In view of the foregoing disadvantages inherent in the known types of outdoor lighting now present in the prior art, the present invention provides an improved phosphorescent paving block, and overcomes the above-mentioned disadvantages and drawbacks of the prior art. As such, the general purpose of the present invention, which will be described subsequently in greater detail, is to provide a new and improved phosphorescent paving block and method which has all the advantages of the prior art mentioned heretofore and many novel features that result in a phosphorescent paving block which is not anticipated, rendered obvious, suggested, or even implied by the prior art, either alone or in any combination thereof.

To attain this, the present invention essentially comprises a phosphorescent paving block having a paving base, and a phosphorescent material in contact with the paving base. Additionally the paving block can also have a light transmitting cover and a light-transmitting base on either side of the phosphorescent material to form a laminate.

There has thus been outlined, rather broadly, the more important features of the invention in order that the detailed description thereof that follows may be better understood and in order that the present contribution to the art may be better appreciated.

The invention may also include a sealing edge and bevels or grooves in either the light transmitting side of the light transmissive cover or on the light receiving side of the light transmissive cover. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved phosphorescent paving block that has all of the advantages of the prior art outdoor lighting and none of the disadvantages.

It is another object of the present invention to provide a new and improved phosphorescent paving block that may be easily and efficiently manufactured and marketed.

It is further object of the present invention to provide a new and improved phosphorescent paving block that is of a durable and reliable construction.

An even further object of the present invention is to provide a new and improved phosphorescent paving block which is susceptible of a low cost of manufacture with regard to both materials and labor, and which accordingly is then susceptible of low prices of sale to the consuming public, thereby making such phosphorescent paving block economically available to the buying public.

Still another object of the present invention is to provide a new phosphorescent paving block that provides in the apparatuses and methods of the prior art some of the advantages thereof, while simultaneously overcoming some of the disadvantages normally associated therewith.

Even still another object of the present invention is to provide a phosphorescent paving block for outdoor lighting which requires no wiring and hence no electrical contractor to install.

Still yet an o the r object of the present invention is to provide a phosphorescent paving block for outdoor lighting that increases safety by its use.

Yet another object of the present invention is to provide a phosphorescent paving block for outdoor lighting that uses no electricity.

Still even another object of the present invention is to provide a phosphorescent paving block for outdoor lighting that is aesthetically pleasing.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
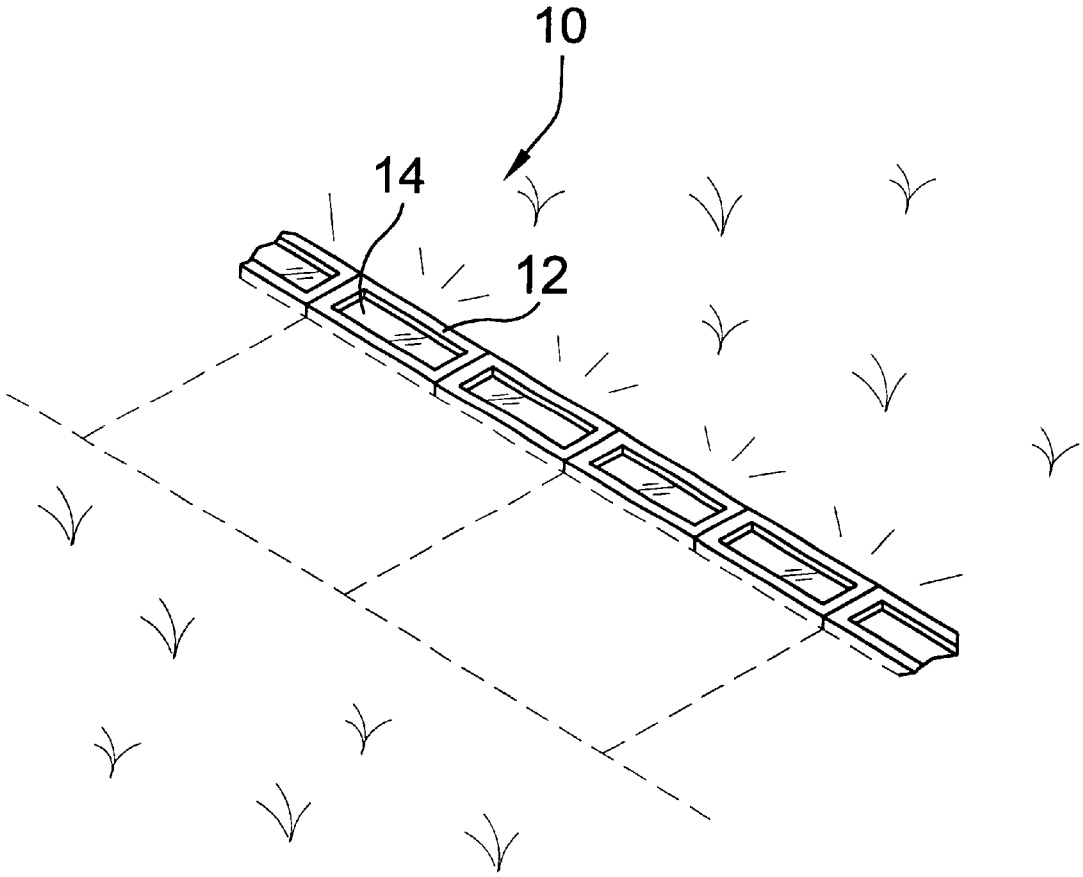
FIG. 1 is a top perspective view of the preferred embodiment of the phosphorescent paving block constructed in accordance with the principles of the present invention in use.

Referring now to the drawings, and particularly to FIGS. 1–5, a preferred embodiment of the phosphorescent paving block of the present invention is shown and generally designated by the reference numeral 10.

In FIG. 1, the new and improved phosphorescent paving block 10 of the present invention for outdoor lighting is illustrated and will be described. More particularly, the phosphorescent paving block 10 is shown in use, with a light transmissive cover light transmitting side 14 shown and being surrounded by a paving base 12. The light transmissive cover light transmits side-emitting light to the surrounding area.

Figure 2:
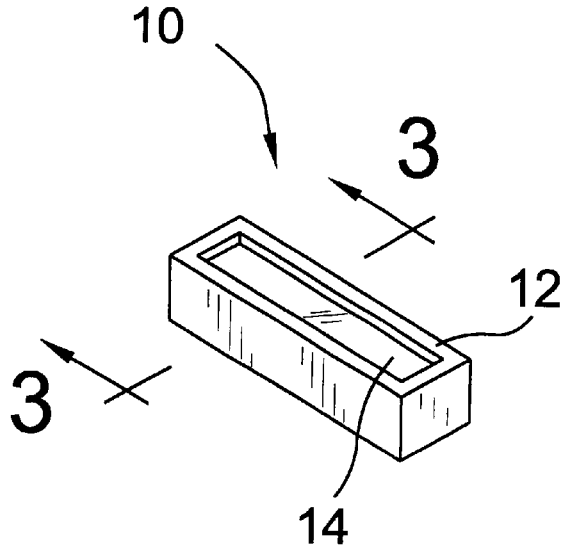
FIG. 2 is a top perspective view of the phosphorescent paving block of the present invention.

In FIG. 2, the phosphorescent paving block 10 is shown in top perspective view with the light transmissive cover light transmitting side 14 shown and being surrounded by the paving base 12.

Figure 3:
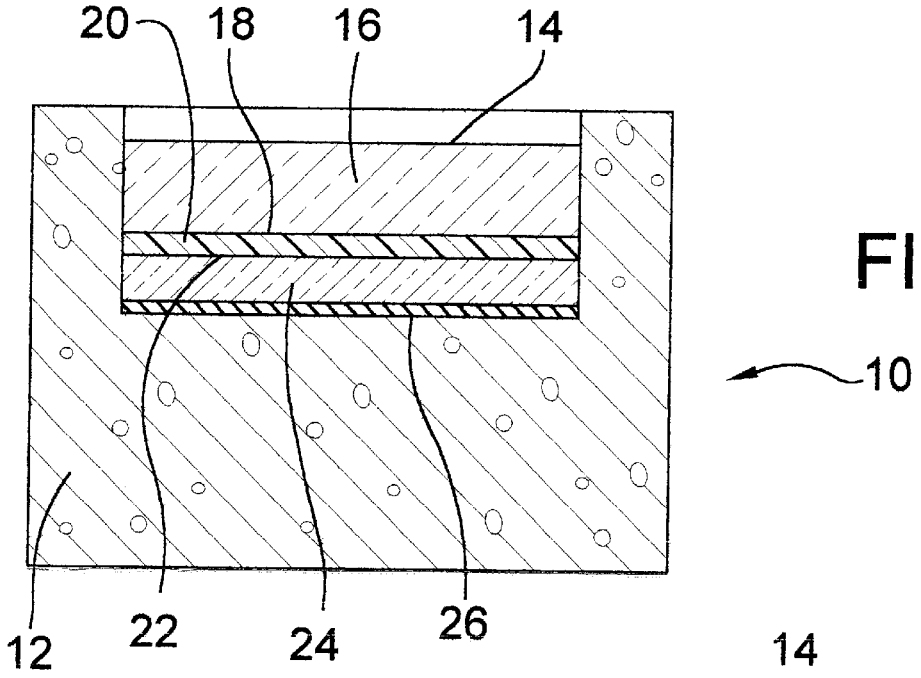
FIG. 3 is a sectional view 3—3 of FIG. 2 of the phosphorescent paving block of the present invention.

In FIG. 3, the phosphorescent paving block 10 is shown in cross-section view. The paving base 12 is connected to a light transmissive base 24 having an attachable side 26 and a light gathering side 22, the attachable side 26 being mounted to the paving base 12. A phosphorescent material 20 is in direct contact with the light transmissive base 24 light gathering side 26. A light transmissive covers 16 has a light receiving side 18 and the light transmitting side 14. The light receiving side 18 is in direct contact with the phosphorescent material 20. The light transmissive cover 16 is attached to the paving base 12.

Figure 4:
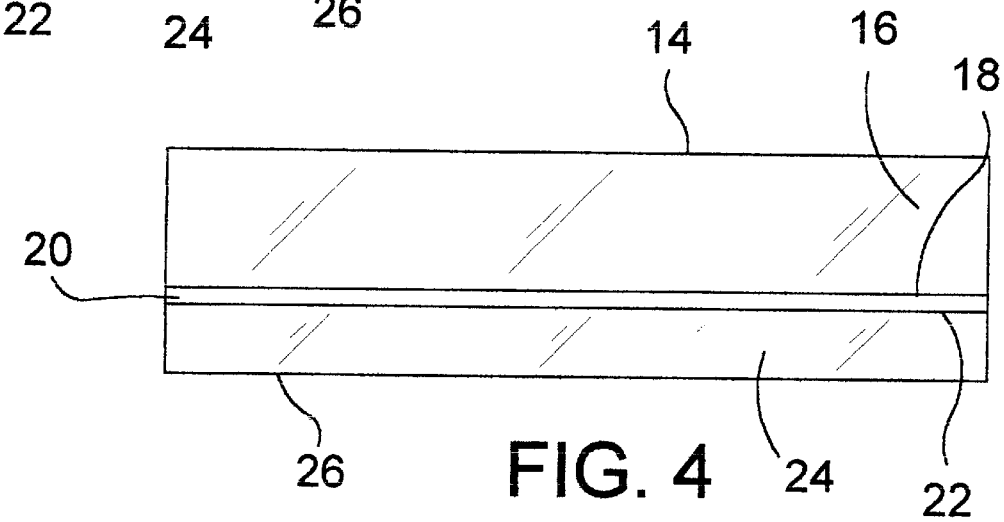
FIG. 4 is a cross sectional view of the phosphorescent paving block of the present invention.

In FIG. 4, the phosphorescent light transmissive laminate of the phosphorescent paving block is shown. The light transmissive base 24 has the attachable side 26 and the light gathering side 22. The phosphorescent material 20 is in direct contact with the light transmissive base 24 light gathering side 26. The light transmissive cover 16 having the light receiving side 18 and the light transmitting side 14, the light receiving side 18 being in direct contact with the phosphorescent material 20.

Figure 5:
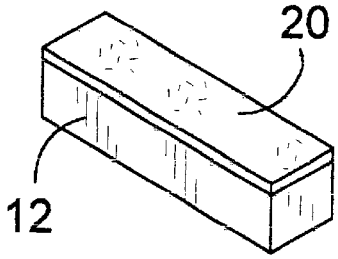
FIG. 5 is a top perspective view of the second embodiment the phosphorescent paving block of the present invention.

In FIG. 5 the phosphorescent paving block 10 is shown with the phosphorescent material 20 in direct contact with the paving base 12.

While a preferred embodiment of the phosphorescent paving block has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable optically trasmissive material such as plastic may be used instead of the glass described. Also, plastic, metal or similar material may be used for the enclosure instead of the concrete described. The phosphorescent material may be made of polyester resin with phosphorescent pigment, clear oil based polyurethane with phosphorescent pigments or any like material. And although phosphorescent paving block being used for outdoor lighting have been described, it should be appreciated that the phosphorescent paving block herein described is also suitable for trim lighting on a fence.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A phosphorescent paving block comprising:

a paving base;

a light transmissive base having an attachable side and a light gathering side, said attachable side being mounted to said paving base;

a phosphorescent material in direct contact with said light transmissive base light gathering side; and a light transmissive cover having a light receiving side and a light transmitting side, said light receiving side in direct contact with said phosphorescent material, said light transmissive cover being attached to said paving base.

* * * * *